United States Patent [19]

Siwersson et al.

[11] Patent Number: 4,905,920

[45] Date of Patent: Mar. 6, 1990

[54] MILLING DEVICE

[75] Inventors: Olle L. Siwersson, Hensingborg; Jan Å. T. Loodberg, Nyhamnsläge; Arne E. Wall, Landskrona, all of Sweden

[73] Assignee: AB Scaniainventor, Helsingborg, Sweden

[21] Appl. No.: 288,255

[22] PCT Filed: May 2, 1986

[86] PCT No.: PCT/SE86/00201

§ 371 Date: Dec. 19, 1988

§ 102(e) Date: Dec. 19, 1988

[87] PCT Pub. No.: WO87/06500

PCT Pub. Date: Nov. 5, 1987

[51] Int. Cl.[4] ..... B02C 2/06; B02C 19/00

[52] U.S. Cl. ..... 241/258; 241/207

[58] Field of Search ..... 241/258, 207, 209

[56] References Cited

U.S. PATENT DOCUMENTS

| | | | |
|---|---|---|---|
| 1,799,476 | 4/1931 | Newhouse | 241/209 |
| 1,976,728 | 11/1933 | McCatrell | 241/209 |
| 2,186,596 | 1/1940 | Spohn, Jr. | 241/258 X |
| 4,434,944 | 3/1984 | Bodine | 241/258 |

*Primary Examiner*—Timothy V. Eley

*Attorney, Agent, or Firm*—Browdy & Neimark

[57] ABSTRACT

A milling device comprises two milling bodies one of which is hollow and encloses the other, and a driving unit connected to one of the milling bodies via a shaft nonrotatably connected with the one milling body to cause it to rotate about its own axis in rolling contact with the other milling body. Both milling bodies are universally movable in a surface essentially transverse to the axis of rotation, but are actuated by a return force which increases as the pendulum movement increases. To provide for the return force, the two milling bodies are supported in pendulum fashion, or use is made of resilient means, such as springs.

12 Claims, 4 Drawing Sheets

MILLING DEVICE

BACKGROUND OF THE INVENTION

1. Field of the Invention

The present invention relates to a milling device comprising two milling bodies, one of which is hollow and encloses the other, and a driving unit connected to one of said milling bodies via a shaft nonrotatably connected with said one milling body to cause it to rotate about its own axis in rolling contact with the milling body.

2. The Prior Art

Milling devices of this type, such as pendulum mills, are previously known and operate efficiently in that the milling stock, because of the active rotation of one of said milling bodies, is subjected to both compressive forces and shear forces, whereby a highly efficient comminution of the milling stock is achieved. Prior art pendulum mills comprise a sleeve-shaped and stationary casing, against the inner side of which a rotor is caused to roll for crushing the milling stock introduced therebetween. A major proportion of the energy supplied to the rotor is transferred to the stationary casing which thus is subjected to heavy vibrations and must be given a very sturdy construction in order not to shake apart. As a consequence, also the efficiency of such pendulum mills will be unsatisfactory, and furthermore there is a risk that the crushed milling stock will adhere to the inner side of the casing.

SUMMARY OF THE INVENTION

It therefore is the object of the present invention to provide a milling device which is of the above-mentioned type and which eliminates the shortcomings of prior art pendulum mills.

To this end, the milling device is characterised in that both milling bodies are universally movable in a surface essentially transverse to the axis of rotation, but are actuated by a return force which increases as the pendulum movement increases.

To generate the return force, both milling bodies can be supported in pendulum fashion, such that the pendulum centers lie on the same side of said milling bodies or each on one side thereof. Alternatively, or in combination with the pendulum suspension, elastic means, such as springs, may be provided in order to generate the return force.

Preferably, both milling bodies are symmetrical with respect to rotation, but there is nothing to prevent their being oval or of some other noncircular shape, whereby the crushing force can be varied along the path of movement of the contact point.

The milling bodies are suitably arranged to move about a common center and, more particularly, to effect their pendulum movements in balanced phase opposition.

The milling surfaces of the milling bodies preferably are designed such that the contact point therebetween constitutes the apex of a gap which is wedge-shaped in the direction of the axis of rotation, thereby to facilitate multiple crushing of particles during a single run through the milling device.

Preferably, only one of said milling bodies is rotated so that the other milling body is essentially nonrotatable in the surface of the universal movability. However, it is also possible that both milling bodies are actively driven for rotation, either in the same direction or in opposite directions, and naturally in mutual rolling contact in both instances.

If one milling body is driven and the other essentially nonrotatable, both milling bodies being symmetrical with respect of rotation, the geometrical location of the contact point between the milling bodies will be a circle whose diameter is less than the diameter of the milling surface of the surrounding milling body. Each point on the surrounding milling body will move along a circle whose diameter is essentially less than the diameter of the milling surface of the surrounding milling body, and each point on the milling surface of the enclosed milling body will describe a hypocycloid.

A number of advantages are obtained by a milling device designed in accordance with the present invention. Thus, the milling bodies are counterbalanced, such that no essential vibration will occur in the frame of the milling device. Furthermore, the transfer of energy to the milling stock will be optimal, and use may be made of milling bodies having comparatively small masses. The pendulum movement of the surrounding milling body also distributes the milling stock introduced into the milling device, and furthermore the adherence of milling stock to the milling surface of the surrounding milling body is effectively prevented.

BRIEF DESCRIPTION OF THE EMBODIMENT

The invention will be described in more detail below, reference being had to the accompanying drawings.

DESCRIPTION OF THE PREFERRED EMBODIMENT

Figure 1:
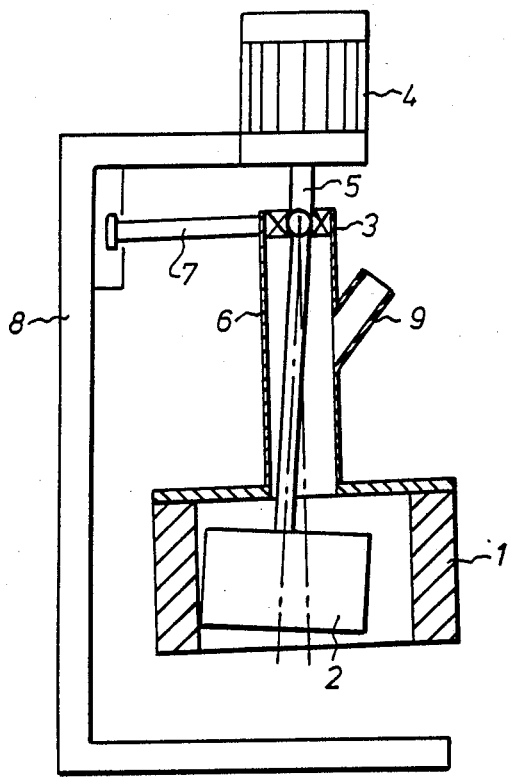
FIG. 1 is a lateral view, partially in cross-section, of an embodiment of the milling device according to the invention.

The embodiment shown in FIG. 1 of a milling device according to the invention comprises two milling bodies 1 and 2 suspended in pendulum fashion in a bearing 3 on the shaft 5 of a motor 4. The milling bodies 1 and 2 are symmetrical with respect to rotation and concentric with a common center axis at standstill. The milling body 1 is designed as a cylindrical casing and surrounds the milling body 2 which also is cylindrical and nonrotatably connected with the rotor shaft 5 via a universal joint in the bearing 3. At the level of the bearing 3, the milling body 1 is provided in its tubular pendulum arm 6 with a radially directed brace 7 connected at its free outer end to a frame 8 carrying the motor 4 and serving to prevent rotation of the milling body 1 about the common center axis. A branch tube on the tubular pendulum arm 6 serves as the infeed opening for the milling stock.

By rotating the milling body 2 by means of the motor 4, such that the outer milling surface of the milling body 2 is in contact with the inner milling surface of the casing 1, the milling body 2 is caused, by rotating about its own axis, to effect a rotating pendulum movement during which it is urged against the inner side of the casing 1. Depending upon the relationship between the diameters of the milling surfaces of the milling bodies 1 and 2, different higher speeds of rotation are obtainable for the pendulum movement of the milling body 2 in relation to the speed of rotation of the milling body 2 about its own axis, i.e., the speed of the motor 4.

As will appear from FIG. 1, the milling gap between the milling bodies 1 and 2 is wedge-shaped and widens upwardly from the contact point between the milling bodies 1 and 2, said contact point forming the apex of the wedge. By causing the milling body 2 to effect its pendulum movement at a sufficiently high speed of rotation in relation to the height of the wedge-shaped milling gap, an individual stock particle falling down into the milling gap can be crushed repeatedly, and thus each stock particle can be crushed in several stages to increasingly finer particles.

In order to prevent, during operation of the milling device shown in FIG. 1, the milling body 2 from travelling axially during its movement along the inner side of the milling body 1, the milling bodies 1 and 2 are so dimensioned and mounted that their center of force lies in one and the same plane essentially perpendicular to the common center axis, more particularly such that the line of application of the centrifugal force of the milling body 2 essentially coincides with the line of application of the centripetal force of the milling body 1.

Figure 2:
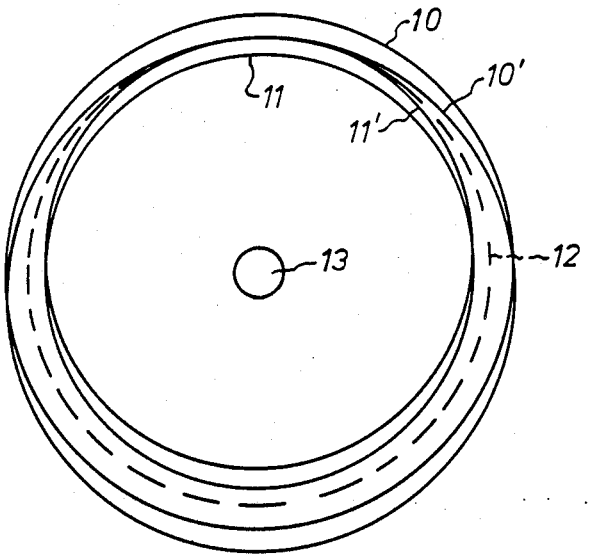
FIGS. 2–3 illustrate the movement pattern of the milling bodies in the milling device as shown in FIG. 1.

The pattern of movement of the milling bodies 1 and 2 will now be described in more detail, reference being had to FIGS. 2 and 3. In FIG. 2, the milling surfaces of the milling bodies 1 and 2 are designated 10 and 11 when the milling body 2 is stationary. The surfaces 10 and 11 are then concentric. When the milling body 2 is rotated in contact with the inner side of the milling body 1, both milling bodies 1 and 2 will perform a rotating pendulum movement. The contact point between the milling surfaces 10 and 11 will describe a circle 12, the contact circle, which lies between the circles 10 and 11 and whose position therebetween depends upon the relationship between the masses of the milling bodies 1 and 2. Circles 10' and 11' indicate the position of the milling surfaces of the milling bodies 1 and 2 during milling when the center of the milling body 2 moves along a circle 13.

Figure 3:
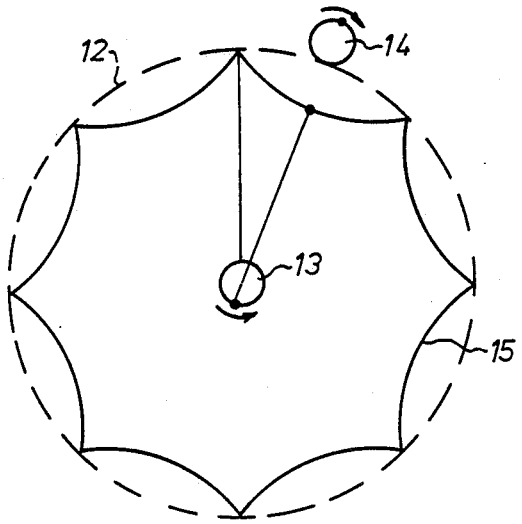

FIG. 3 provides a further illustration of the rotating pendulum movement of the milling bodies 1 and 2. More particularly, the milling body 1 will perform a pendulum movement which is a circular movement along a circle 14 having the same diameter as the circle 13 in FIG. 2. Each point on the milling surface of the milling body 2 will follow a path of movement which is a hypocycloid 15. More particularly, the milling bodies 1 and 2 will move in phase opposition relative to one another, as indicated by the arrows at the circles 13 and 14 in FIG. 3. The milling gap between the milling bodies 1 and 2, which thus moves around the inner side of the milling body 1 during rotation of the contact point, thus is formed in that the milling bodies 1 and 2 move toward one another to the contact circle and then move apart again. As a result of this movement pattern, milling stock supplied between the milling bodies 1 and 2 will be distributed along the inner side of the milling body 1 during the inward movement thereof toward the contact circle and, after crushing, is allowed to continue downwardly between the milling bodies 1 and 2 without being subjected to centrifugal forces. In this manner, the milling stock is effectively prevented from adhering to the inner side of the milling body 2, i.e., the milling surfaces of the milling bodies 1 and 2 are always kept clean during the entire milling operation.

To prevent stock supplied to the upper side of the milling body 2 from passing through the milling device without being crushed, the milling body 2 must have a given minimum diameter in relation to the milling body 1, and furthermore the pendulum velocity of the milling body 2 must be suitably dimensioned in relation to the height of the milling gap. As regards the relationship of the diameters, the diameter of the milling surface of the surrounding milling body 1 must not be greater than twice the diameter of the milling surface of the enclosed milling body 2. More particularly, the diameter of the contact circle 12 must not be greater than twice the diameter of the milling body 2.

Figure 4:
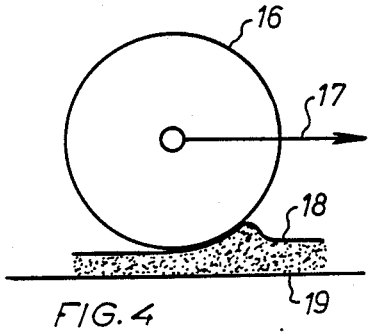
FIGS. 4–5 illustrate the difference between active and passive actuation of milling body movement.
Figure 5:
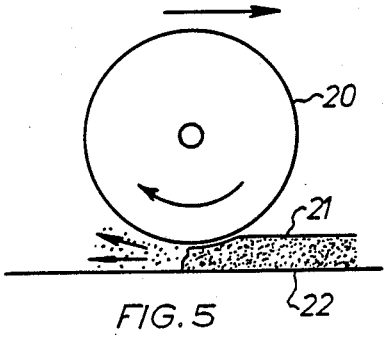

FIGS. 4 and 5 illustrate the difference between passive and active actuation of the movement of a circular milling body. A translational force, indicated by the arrow 17, is applied to the milling body 16 shown in FIG. 4, whereby the milling body 16 rolls across the milling stock 18 on a base 19. In this manner, the milling body 16 will exert a compressive force on the milling stock 18, while simultaneously pushing before it the milling stock 18 so that a bank of milling stock is formed in front of the milling body 16. If instead, in accordance with FIG. 5, a milling body 20 is caused to roll across milling stock 21 on a base 22 by being rotated about its center axis, the milling body 20 will exert a compressive force on the milling stock 21 and, furthermore, a shear force thereon. In this manner, no bank of milling goods will be formed in front of the milling body 20 which instead spreads the milled stock behind it. By the active actuation according to FIG. 5, the individual milling stock particles are comminuted or crushed by a combination of pressure and shear. It therefore is preferred that the particles to be milled are supplied in as thin layer as possible between the milling bodies 1 and 2, such that each individual particle will be subjected to the said compressive and shear forces.

Figure 6:
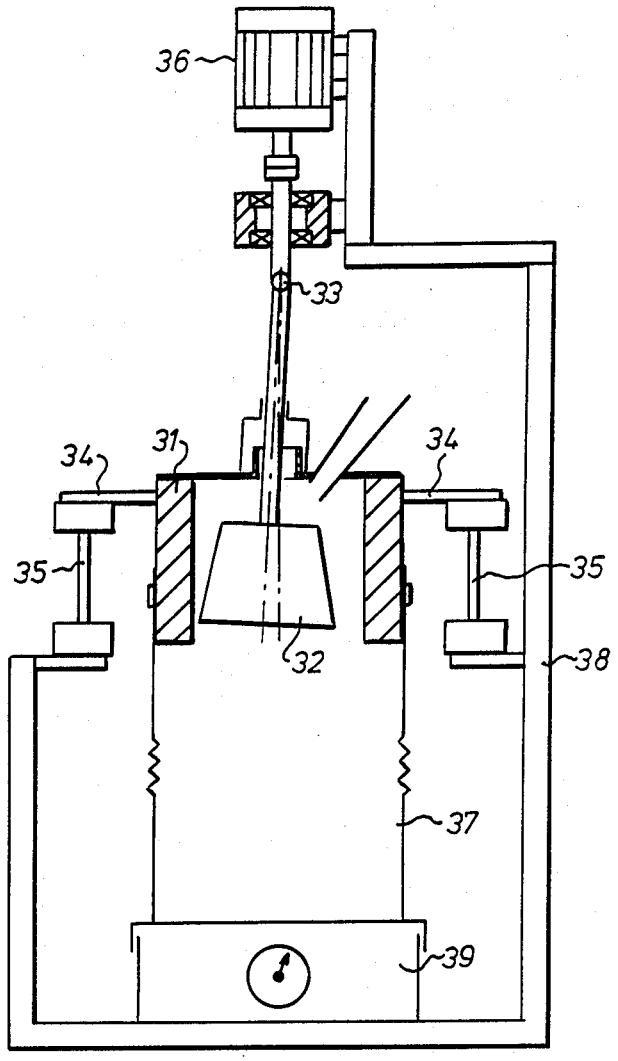
FIG. 6–9 are lateral views, partially in cross-section, of further embodiments of the milling device according to the invention.

FIGS. 6–9 illustrate further embodiments of the milling device according to the invention. FIG. 6 shows an embodiment in which the enclosed milling body 32 is suspended in pendulum fashion with its pendulum center 33 above the milling body 32. The milling body 31 is supported, via radially directed arms 34 by vertical uprights 35 which are laterally flexible and spring back into the position illustrated. In this manner, the milling body 31 will perform a pendulum movement with a pendulum arm of a length almost approaching infinity. The pendulum center here lies below the milling body 31. The uprights 35 are supported by the frame 38 which also carries an electric motor 36 for operating the milling body 32. The milling body 31 is connected with a container 37 for collecting the milled stock, and a weighing apparatus 39 is provided to determine the weight of the milled stock.

Figure 7:
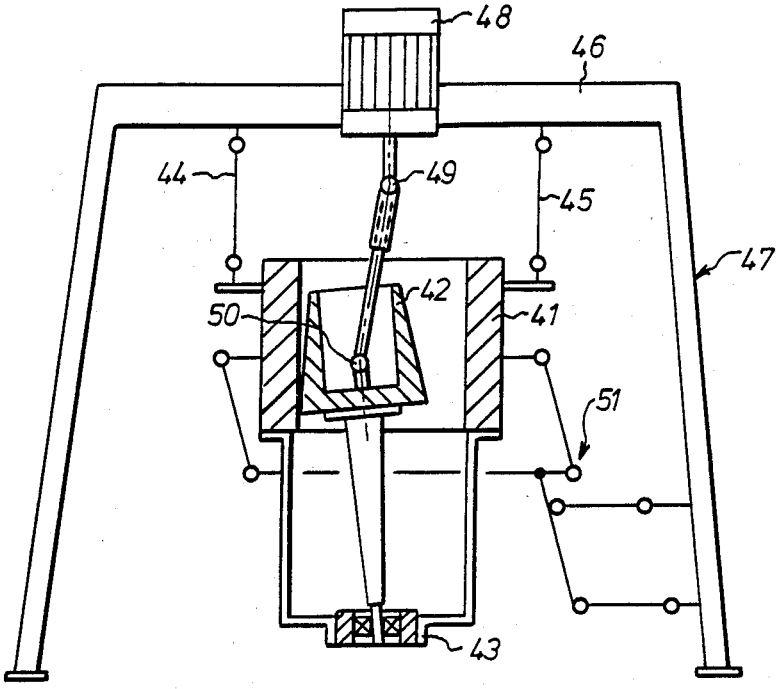

In the embodiment illustrated in FIG. 7, the pendulum center 43 of the two milling bodies 41 and 42 lies below the milling bodies. In this case, a force moving the bodies 41 and 42 back to the center is provided by means of links 44 and 45 connecting the milling body 41 with a crossbar 46 on a frame 47. A motor 48 is nonrotatably connected with the milling body 42 via a splined coupling and two universal joints 49 and 50. Furthermore, the milling body 41, to prevent rotation thereof, is connected with the frame 47 via a torque-absorbing linkage 51.

Figure 8:
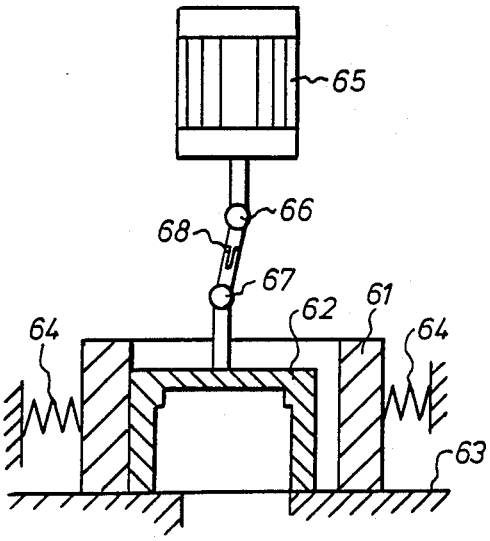

The embodiment shown in FIG. 8 has milling bodies 61 and 62 which are universally movable in a plane 63. To facilitate movement of the milling bodies 61 and 62 on the plane 63, suitable roller bearings (not shown) may be provided. In order to restrict the universal movability of the milling bodies 61 and 62 in the plane 63, springs 64 are provided between the milling body 61 and stationary supports. The milling bodies 61 and 62 may thus be said to constitute pendulums with pendulum arms of infinite length. A motor 65 driving the milling body 62 for rotation is connected with said milling body via two universal joints 66 and 67 and a splined coupling 68 for telescopic movement.

Figure 9:
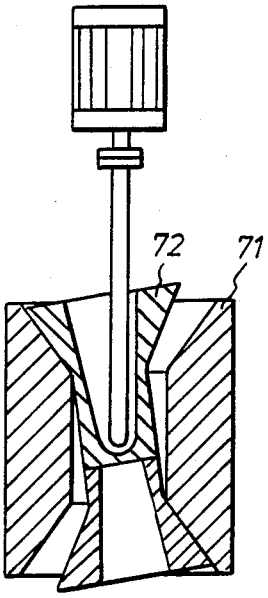

FIG. 9 shows still another form of milling bodies, more particularly a sleeve-shaped milling body 71 having a conical inlet and a conical outlet widening away from another and interconnected by a cylindrical intermediate portion. The enclosed milling body 72 has a complementary shape, but its conical portions have a smaller cone angle.

A number of modifications of the above-mentioned embodiments of the milling device are conceivable within the scope of the invention. However, a feature which all embodiments have in common is that the milling bodies shall be universally movable in a surface essentially transverse to the axis of rotation, but shall be actuated by a return force which increases as the pendulum movement is increased. The return force may be provided by means of a pendulum suspension or by resilient means, such as springs. A combination of resilient means and pendulums is also possible. In the pendulum embodiment, the pendulum arms of the milling bodies need not have the same length, and the pendulum centers of the milling bodies may lay either on the same side of the milling bodies or each on one side thereof.

Moreover, the milling bodies need not be circular, but may just as well have some other suitable noncircular shape, in which case the crushing force will vary along the path of movement of the contact point.

It is also possible to provide for rotation of both milling bodies, preferably in opposite directions. Instead of rotating only the enclosed milling body, it is possible to rotate only the surrounding milling body.

The device according to the invention provides for pendulum movement of the milling bodies in phase opposition, provided of course that the speed of the rotating pendulum movement imparted to the driven milling body or bodies is higher than the critical speed.

Finally, the milling device according to the invention can be used for both dry milling and wet milling.

We claim:

1. A milling device comprising:

a first milling body;

a second milling body which is hollow and encloses said first milling body; and a driving unit for rotating a shaft which is nonrotatably connected with one of said first and second milling bodies, to cause said one of said first and second bodies to rotate about its own axis in rolling contact with the other of said first and second bodies;

said milling device further comprising:

means suspending said first and second bodies for universal movement in a plane essentially transverse to the axis of rotation, whereby said first and second bodies perform a pendulum movement during rotation of said shaft; and means for generating a return force opposing said pendulum movement and increasing as the pendulum movement increases.

2. A milling device as claimed in claim 1, wherein both milling bodies are supported in pendulum fashion to generate the return force.

3. A milling device as claimed in claim 1, wherein the pendulum centers of said milling bodies are located on the same side of said milling bodies.

4. A milling device as claimed in claim 3, wherein the pendulum centers of said milling bodies are located each on one side of said milling bodies.

5. A milling device as claimed in claim 1, wherein said means for generating comprises resilient means to generate the return force.

6. A milling device as claimed in claim 1, wherein said milling bodies are adapted to move about a common center.

7. A milling device as claimed in claim 1, wherein both milling bodies are symmetrical in respect of rotation.

8. A milling device as claimed in claim 7, wherein the relationship between the diameter of the milling surface of the surrounding milling body and the diameter of the milling surface of the enclosed milling body is less than 2.

9. A milling device as claimed in claim 1, wherein at least one of said milling bodies is noncircular.

10. A milling device as claimed in claim 1, wherein said milling bodies shaped such that the contact point between them forms the apex of a gap which is wedge-shaped in the direction of the axis of rotation.

11. A milling device as claimed in claim 1, wherein the force center of said milling bodies lies in one and the same plane essentially perpendicular to said axis of rotation.

12. A milling device as claimed in claim 1, wherein the other of said milling bodies is essentially nonrotatable in said plane.

* * * * *